United States Patent [19]

Sakai

[11] Patent Number: 4,486,902

[45] Date of Patent: Dec. 11, 1984

[54] FUSION BONDING INTERLINING STRIP

[75] Inventor: Katsuhide Sakai, Osaka, Japan

[73] Assignee: Firma Carl Freudenberg, Weinheim, Fed. Rep. of Germany

[21] Appl. No.: 454,639

[22] Filed: Dec. 30, 1982

[30] Foreign Application Priority Data

Feb. 3, 1982 [JP] Japan ..... 57-16740

[51] Int. Cl.[3] ..... A41D 1/00

[52] U.S. Cl. ..... 2/97; 2/232; 428/195; 428/198; 428/284; 428/340

[58] Field of Search ..... 428/195, 196, 197, 198, 428/200, 403, 219, 283, 327, 340, 284; 2/232, 97

[56] References Cited

U.S. PATENT DOCUMENTS

| | | | |
|---|---|---|---|
| 3,168,749 | 2/1965 | Cola | 2/232 |
| 3,682,738 | 8/1972 | Smith | 428/198 |
| 4,326,003 | 4/1982 | Bouhaniche | 428/198 |
| 4,354,890 | 10/1982 | Maffey | 428/195 |

*Primary Examiner*—James J. Bell

*Attorney, Agent, or Firm*—Kenyon & Kenyon

[57] ABSTRACT

This application discloses a fusion bonding interlining strip which may be used to close facings, and bottom and/or sleeve hems in garments. The fusion bonding interlining strip comprises a fabric base strip, wherein the surface of the base strip is longitudinally divided into a bonding portion and a non-bonding portion of about equal areas, wherein the bonding portion includes a fusion bonding adhesive.

4 Claims, 6 Drawing Figures

FUSION BONDING INTERLINING STRIP

FIELD OF THE INVENTION

The present invention relates to a fusion bonding interlining strip for use in closing facings, and bottom and/or sleeve hems in garments.

BACKGROUND OF THE INVENTION

Double-coated adhesive interlinings have been employed to seal front body facings and bottom and/or sleeve hems in garments. Double-coated adhesive interlinings consist essentially of a heat bonding resin arranged in a cobweb pattern on release-paper sheets. Double-coated adhesive interlinings have been used to integrate pieces of garment cloth into one piece by placing the adhesive between garment pieces, and pressing the composite together with an iron or another pressing machine. When such double-coated adhesive interlinings are used, disadvantages arise since the pieces of garment cloth and the interlining are positively integrated into one, and as a result the cloth is adversely affected with respect to feel and flexibility.

One of the conventionally employed methods for sewing fabrics in order to produce men's garments and the like is referred to as reversing. In accordance with the reversing method, the facing fabric, the interlining and the lining fabric are sewn together in a bag-like shape, and in reverse order. The garment is formed by turning the bag inside out so that the facing fabric is now the outermost layer of the garment. The difficulty with this method is that after the bag is turned inside out, blind stitching cannot be done with facings and the like in the front body, which makes it impossible to obtain a structurally stable garment.

Having endeavored to find a solution to the foregoing problems, the present invention provides a fusion bonding interlining strip which overcomes the difficulties associated with the conventional interlining methods and processes discussed above.

BRIEF DESCRIPTION OF THE INVENTION

In accordance with the foregoing objectives, this invention provides a fusion bonding interlining strip useful for closing garment facings, and bottom and/or sleeve hems, comprising a fabric base strip wherein the surface of the base strip is longitudinally divided into a bonding portion and a non-bonding portion of about equal areas, and wherein the bonding portion of the base strip includes a fusion bonding adhesive suitable for adhering fabric layers together, and the non-bonding portion of the surface of the base strip does not include a fusion bonding adhesive.

In another embodiment, the fusion bonding interlining strip comprises a fabric base strip wherein the first surface of said strip is divided longitudinally into a bonding portion and a non-bonding portion of substantially equal areas, and the second surface of the base strip which is opposite to the first surface is also divided longitudinally into a bonding portion and non-bonding portion of substantially equal area, wherein the bonding portion of the first surface opposes the non-bonding portion of the second surface, and the non-bonding portion of the first surface opposes the bonding portion of the second surface, and wherein the bonding portions of the first and second surfaces include a fusion bonding adhesive, and the non-bonding portions of the first and second surfaces do not include fusion bonding adhesive.

BRIEF DESCRIPTION OF THE FIGURES

The invention will be described with reference to the appended FIGS. wherein.

DETAILED DESCRIPTION OF THE INVENTION

Figure 1:
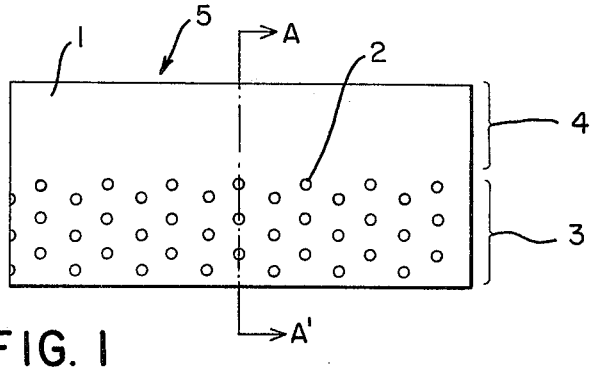
FIG. 1 is a plan view showing one embodiment of the invention.
Figure 2:
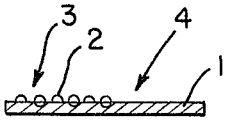
FIG. 2 is an enlarged section taken along line A—A' of FIG. 1.

As FIG. 1 shows in plan view, the invention provides a bonding type interlining strip (5) having a base strip (1) provided with a fusion bonding agent (2) on at least one surface of the base strip. The fusion bonding type interlining strip is divided substantially equally into a fusion bonding area (3) having a fusion bonding agent (2) provided thereon, and a non-fusion bonding area (4) to which the fusion bonding agent has not been applied. FIG. 2 is an enlarged section of the fusion bonding type interlining strip taken along line A—A' of FIG. 1.

Figure 3:
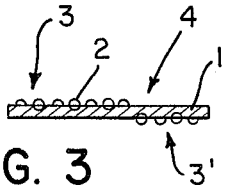
FIG. 3 is an enlarged sectional view showing another embodiment of the invention.

Preferably, a second fusion bonding area (3') is formed on the surface of the base strip (1) which opposes the non-bonding area (4). An enlarged section of this embodiment is shown in FIG. 3, which illustrates a base strip (1) having bonding agent on both the upper (3) and lower (3') surfaces of the base strip.

In the present invention, a base strip may be employed wherein the ratio of the (transverse) width to the (longitudinal) length of the base strip is about 1:1.5 or more, with the width of the base strip being about 10 mm or more, or preferably about 20 mm to about 100 mm. With regard to the length of the base strip, general practice is that the base strip is wound on a core and is unrolled and cut to a suitable desired length. For example, the length may be about 100 mm for bottom hem closing, and about 400 mm to about 900 mm for facing closing.

For the purpose of the present invention, the base strip may be any woven, knitted, and non-woven fabrics of natural and/or synthetic fibers or the like which are conventionally employed as interlining fabrics: for example, synthetic fibers such as polyamides, nylon, acrylic, rayon, as well as natural fibers such as cotton. However,non-woven fabrics, wherein fibers are bonded together by a binder or fusible component fiber, are preferable since they are not subject to fraying at, or from, cut ends, as is often the case with woven or knitted fabrics. Thus, non-wovens may result in interlining strips having better shape stability Non-wovens may be selected as required with respect to thickness and/or hand or other desired properties for a given application. Non-woven fabrics used for the purpose of this invention may, for example, have a fabric weight of about 20 to about 70 g/m$^2$.

Fusion bonding agents suitable for use herein include fabric adhesives such as polyamide, polyester, polyvinyl chloride resins or copolymers thereof, or the like, in various forms such as powder, paste, solution, etc. The fusion bonding agent employed herein is an adhesive suitable for adhering fabric layers together: for example, when the fusion bonding adhesive is placed between the fabric layers, and the fabric layers are pressed together under conventional fabric pressing pressures and temperatures.

Various methods may be used to apply the fusion bonding agents to the base strip. For example, the fusion bonding agents may be applied to the base strip by being sprayed onto the base strip in powder form, or coated onto the base strip in paste form mixed with emulsifying and/or thickening agents and the like, or in paste form thickened with a resin emulsion, or printed in a spot, linear, or dot pattern. In any case, the fusion bonding agent is applied in a belt-form pattern onto the base strip (1) as is shown in FIG. 1.

In order to prepare an interlining strip of the present invention, for example, several to a dozen or more fusion bonding areas alternating with non-bonding areas may be arranged longitudinally across a long piece of non-woven fabric. Subsequently the fabric is slit longitudinally into a series of tapes, each tape including one bonding area (3) and a non-bonding area (4). If the piece of fabric is a broad non-woven fabric having an elongated width, it may be desirable to form alternating series of fusion bonding and non-fusion bonding areas transversely across the fabric and then to cut the fabric transversely into strips, each strip having a fusion bonding and non-fusion bonding portion. Especially when employed to seal a facing, the heat bonding interlining of the invention provides good upward/downward flexibility and excellent wear-feel.

The fusion bonding agent need not cover the entire fusion bonding area (3). The coverage of such agent is acceptable if the coating of the bonding agent as a whole extends in a belt-like pattern in the lengthwise direction of the base sheet. Therefore, not all portions, including lateral ends, of the fusion bonding area (3) in FIG. 2 may be covered with the fusion bonding agent. No particular care is needed in ironing or pressing with respect to fusion bonding area (3') on the back side in FIG. 3, if said area (3') does not overlap with the fusion bonding area (3) on the front side. Without overlapping of fusion bonding areas, the interlining will in no way affect hand or the like of the garment cloth.

The manner in which the fusion bonding tape interlining strip of the invention is used is explained with reference to the FIGS. 4 through 6.

Figure 4:
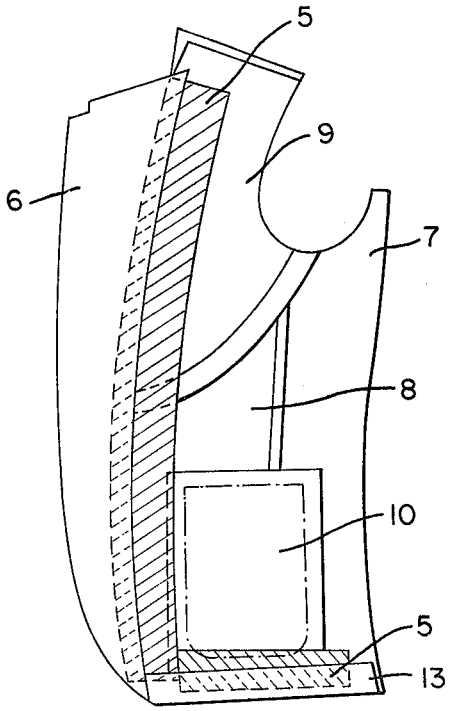
FIG. 4 is a plan view showing a front body (7) in which a fusion bonding interlining material in tape form is employed.

FIG. 4 is a plan view showing a front body (7) in a man's garment as an interlining or the like is applied thereto, employing the fusion bonding interling strip of this invention. The obligue line portion (5) in FIG. 4 indicates the fusion bonding interlining strip. The portions concealed behind the facing and bottom facing are shown by dotted lines. As shown by FIG. 4, a front body (7), breast padding (9), front interlining (8) and pocketing (10) are fusion bonded by interlining strip (5) to facing (6) and bottom facing (13). The fabric layers are bonded together by pressing at conventional ironing temperatures. The manner in which the fusion bonding interlinging strip (5) is employed to bond facings to various garment layers is explained further with reference to FIGS. 5 and 6.

Figure 5:
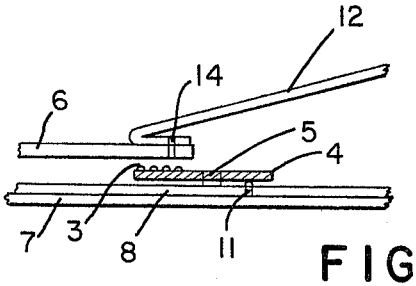
FIG. 5 is a sectional view showing the manner in which a facing is sealed with a fusion bonding interlining strip of the present invention.

FIG. 5 is a sectional view showing the manner of closing a facing (6) in a garment employing the fusion bonding interlining strip (5) of the present invention. FIG. 6 is a sectional view showing the manner in which bottom facing is closed employing the fusion bonding strip (5) of the present invention.

As FIG. 5 illustrates, facing (6) and a front lining (12) are sewn together with a tack thread (14). The fusion bonding interlining strip (5) is inserted between the facing (6) and a front interlining (8) which is integrally joined to the front body (7) of the garment. It should be noted that the front interlining (8) may be comprised of a breast padding (9) or a pocketing (10), as shown in FIG. 4 in plan view.

As shown in FIG. 5, the non-fusion bonding area (4) of the fusion bonding interlining strip (5) is blinded into position with the front interlining (8) by a blinding thread (11). As a result of this arrangement, the integration of the various fabric layers as shown in FIG. 5 will not adversely affect the hand of the facing fabric.

If the interlining strip includes a second fusion bonding portion such as (3') shown by FIG. 3, integration of the various fabric layers can readily be accomplished by ironing or pressing and without blind stitching. The front lining (12), facing (6), the fusion bonding interlining (5) and garment front body (7) are integrated respectively so that the fusion bonding interlining (5) is enclosed between the front lining and the front body of the fabric.

The fusion bonding area (3) of the fusion bonding interlining (5) is integrated with the facing (6) by ironing or pressing at conventional temperatures. As such, the fusion bonding interlining (5) of the invention facilitates the sewing operation, and aids in minimizing garment sewing.

Furthermore, in the case of reversing, the fusion bonding interlining of the invention solves the problem of finish blind stitching which cannot be accomplished by the conventional reversing method. That is, after a garment is made in a bag-like form, a treatment corresponding to finish blind stitching can easily be effected by ironing or pressing when the interlining of the present invention is employed.

Figure 6:
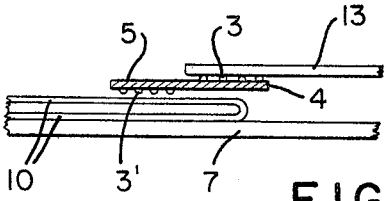
FIG. 6 is a sectional view showing the manner in which a hem bottom is sealed, employing the fusion bonded interlining of the invention.

Another example of the use of the fusion bonding interlining of this invention is shown in FIG. 6. In FIG. 6 the fusion bonding area (3) of the interlining (5) is fusion-bonded to bottom facing (13) and then a pocketing (10) positioned on the front body (7) is integrated with the fusion bonding area (3'). If a front lining is involved, a reverse procedure is followed. Through such integration with pocketing (10), the interlining of the invention permits stabilization in form of the bottom and its vicinity.

While breast padding and the like are used in the upper half of the front body portion of the garment, often there are cases where little or no interlining which serves as a reinforcement is present in the lower half of the garment. Therefore, by integrating the fusion bonding type interlining of the invention with facings over the upper and lower halfs of the front body of the garment, it is possible to provide moderate tension; thus it serves as a reinforcing interlining and permits stabilization of the form of the garment.

As above described, the interlining of the present invention is entirely different from conventional double-coated adhesive interlinings, and is suitable for use in closing facings, bottoms, sleeve edges, and the like. It will be of aid in facilitating sewing operations and in manufacturing garments of good workmanship.

This invention has been described in terms of specific embodiments set forth in detail, but it should be understood that these are by way of illustration and that the invention is not necessarily limited thereto. Modifications and variations will be apparent from the disclosure and may be resorted to without departing from the spirit and scope of the invention, as those of skill in the art will readily understand. Accordingly, such variations are considered to be within the scope and purview of this invention and the following claims.

I claim:

1. A fusion bonding interlining strip comprising a fabric base strip, wherein one surface of said base strip is devoid of adhesive while the opposing surface of said strip is longitudinally divided into a bonding portion and a non-bonding portion of about equal areas and wherein the bonding portion of the surface of said base strip is regularly patterned with a fusion bonding adhesive, the non-bonding portion does not include said fusion bonding adhesive, said interlining strip being effective to close garment facings or hems without adversely affecting the hand of the garment cloth.

2. The fusion bonding inerlining strip according to claim 1 wherein the base is comprised of a non-woven fabric having a fabric weight of about 20 to about 70 $g/m^2$.

3. The fusion bonding interlining strip according to claim 1 wherein the base strip is comprised of a non-woven fabric having a fabric weight of about 20 to about 70 $g/m^2$.

4. A cloth garment comprising: (a) a back fabric structure comprising a facing and a front lining which have been cojoined by sewing together overlapping parallel edges; (b) a front fabric structure comprising an outer front garment body integrally joined to a front interlining; and (c) an interposed fusion bonding interlining strip comprising a fabric base strip wherein the suface of said base strip facing said back fabric structure is longitudinally divided into a bonding portion comprising a fusion bonding adhesive and a non-bonding portion which does not include said adhesive and wherein said non-bonding portion of said interlining strip is sewn to said front fabric structure along a line parallel to and adjacent to said parallel edges of said back fabric structure, and wherein said bonding portion of said interlining strip is thermally bonded to said sewn edges of said back fabric structure whereby said back fabric structure and said front fabric structure are closed without adversely affecting the hand of the garment cloth.

* * * * *